US011268525B2

(12) United States Patent
Lin et al.

(10) Patent No.: US 11,268,525 B2
(45) Date of Patent: Mar. 8, 2022

(54) HEAT DISSIPATION FAN

(71) Applicant: Acer Incorporated, New Taipei (TW)

(72) Inventors: Yu-Ming Lin, New Taipei (TW); Wen-Neng Liao, New Taipei (TW); Cheng-Wen Hsieh, New Taipei (TW); Chun-Chieh Wang, New Taipei (TW); Hung-Chi Chen, New Taipei (TW); Yu-Shih Wang, New Taipei (TW); Ming-Fei Tsai, New Taipei (TW)

(73) Assignee: Acer Incorporated, New Taipei (TW)

( * ) Notice: Subject to any disclaimer, the term of this patent is extended or adjusted under 35 U.S.C. 154(b) by 84 days.

(21) Appl. No.: 16/716,513

(22) Filed: Dec. 17, 2019

(65) Prior Publication Data

US 2020/0191157 A1 Jun. 18, 2020

(30) Foreign Application Priority Data

Dec. 18, 2018 (TW) ..... 107145546

(51) Int. Cl.

| | |
|---|---|
| ***F04D 17/16*** | (2006.01) |
| ***F04D 29/28*** | (2006.01) |
| ***F04D 29/30*** | (2006.01) |
| ***F04D 29/66*** | (2006.01) |

(52) U.S. Cl.

CPC ..... *F04D 17/16* (2013.01); *F04D 29/281* (2013.01); *F04D 29/305* (2013.01); *F04D 29/666* (2013.01); *F05D 2260/961* (2013.01); *F05D 2300/518* (2013.01)

(58) Field of Classification Search

CPC ..... F04D 17/16; F04D 17/162; F04D 29/281; F04D 29/666; F04D 29/305; F05D 2300/518; G06F 1/20; G06F 1/203; H05K 7/20172

See application file for complete search history.

(56) References Cited

U.S. PATENT DOCUMENTS

| | | | | |
|---|---|---|---|---|
| 2,238,749 | A | 4/1941 | Peltier | |
| 9,777,742 | B2 * | 10/2017 | Yang | F04D 29/2216 |
| 10,018,201 | B2 * | 7/2018 | Jia | F04D 29/281 |
| 10,273,971 | B2 * | 4/2019 | Xu | F04D 29/281 |
| 10,408,231 | B2 * | 9/2019 | Veitch | F04D 29/327 |
| 10,480,527 | B2 * | 11/2019 | Van Houten | F04D 29/388 |
| 2003/0123975 | A1 * | 7/2003 | Horng | F04D 29/327 415/119 |

(Continued)

FOREIGN PATENT DOCUMENTS

| | | |
|---|---|---|
| CN | 101285484 | 10/2008 |
| CN | 203175946 | 9/2013 |

(Continued)

OTHER PUBLICATIONS

"Search Report of Europe Counterpart Application", dated Apr. 29, 2020, p. 1-p. 6.

(Continued)

*Primary Examiner* — Topaz L. Elliott
(74) *Attorney, Agent, or Firm* — JCIPRNET

(57) ABSTRACT

A heat dissipation fan suited for being assembled in an electronic device is provided. The heat dissipation fan includes a hub and a plurality of fan blades disposed at and surrounding the hub. The fan blade has ductility and flexibility, and any two fan blades next to each other are in different thickness.

10 Claims, 5 Drawing Sheets

(56) References Cited

U.S. PATENT DOCUMENTS

| | | | | |
|---|---|---|---|---|
| 2006/0204363 | A1* | 9/2006 | Yen | F04D 29/281 416/228 |
| 2008/0247868 | A1* | 10/2008 | Lan | F04D 29/384 415/182.1 |
| 2012/0251323 | A1 | 10/2012 | Chiu et al. | |
| 2014/0072434 | A1 | 3/2014 | Wu | |
| 2014/0127029 | A1 | 5/2014 | Yang et al. | |
| 2014/0147252 | A1* | 5/2014 | Takano | B25F 5/008 415/119 |
| 2014/0286752 | A1 | 9/2014 | Chiou | |
| 2016/0053771 | A1* | 2/2016 | Jia | F04D 25/0613 416/219 A |
| 2017/0002836 | A1 | 1/2017 | Herrou et al. | |
| 2017/0260994 | A1* | 9/2017 | Xu | F04D 29/626 |
| 2018/0058467 | A1* | 3/2018 | Lin | F04D 29/30 |
| 2018/0320705 | A1* | 11/2018 | Van Houten | F04D 29/666 |
| 2019/0078589 | A1* | 3/2019 | Veitch | F04D 29/668 |
| 2019/0128279 | A1* | 5/2019 | Yu | F04D 29/424 |
| 2020/0141242 | A1* | 5/2020 | Nolcheff | F04D 29/324 |

FOREIGN PATENT DOCUMENTS

| | | | |
|---|---|---|---|
| CN | 104074797 | | 10/2014 |
| CN | 105201876 | | 12/2015 |
| CN | 205047514 | | 2/2016 |
| CN | 206555178 | U * | 10/2017 |
| CN | 206617363 | | 11/2017 |
| CN | 207513920 | | 6/2018 |
| CN | 108457898 | | 8/2018 |
| JP | H05-7998 | U * | 2/1993 |
| JP | 2008241188 | A * | 10/2008 |
| JP | 5141808 | | 2/2013 |
| TW | M456682 | | 7/2013 |

OTHER PUBLICATIONS

"Search Report of Europe Counterpart Application", dated Apr. 28, 2021, p. 1-p. 4.

* cited by examiner

HEAT DISSIPATION FAN

CROSS-REFERENCE TO RELATED APPLICATION

This application claims the priority benefit of Taiwan application serial no. 107145546, filed on Dec. 18, 2018. The entirety of the above-mentioned patent application is hereby incorporated by reference herein and made a part of this specification.

BACKGROUND OF THE DISCLOSURE

Field of the Disclosure

The disclosure relates to a heat dissipation fan.

Description of Related Art

In recent years, with the development of the technology industry, electronic devices such as notebooks (NBs), personal digital assistants (PDAs), and smart phones have been frequently used in daily life. These electronic devices usually generate thermal energy during operation, which affects the operational efficiency of the electronic device. Therefore, a heat dissipation module or a heat dissipation component, such as a heat dissipation fan, is usually disposed inside the electronic device to assist in dissipating heat generated by the electronic device to the outside of the electronic device.

In general, since the blades must be in contact with a surrounding structure such as a housing that houses a fan, the fan, when it rotates, would generate a blade pass tone, which is derived from blades moving at fixed frequency through a narrow space in the housing when the fan operates at a fixed speed. As a result, a noise at a fixed frequency and its harmonics will be generated. For a fan with a rotational speed of 5800 rpm (equivalent to 96.67 rps) and 37 blades, the fundamental frequency of the blade pass tone is 96.67*37=3576.66 Hz, that is, the blades pass through the aforementioned narrow space about 3576 times per second, which generates a noise at approximately 3500 Hz.

Based on the above, it is required for practitioners of the field to find out how to provide a technical means to overcome the above-mentioned problem of blade pass tone with the existing housing and fan structure.

SUMMARY OF THE DISCLOSURE

The disclosure provides a heat dissipation fan capable of effectively suppressing blade pass tone.

The heat dissipation fan of the present disclosure is suitable for being disposed in an electronic device. The heat dissipation fan includes a hub and a plurality of fan blades. The fan blades surround and are disposed at the hub. The fan blades ductility and flexibility, and any two fan blades next to each other have different thicknesses.

Based on the above, by arranging fan blades of different thicknesses at the hub, and that the fan blades have ductility and flexibility, when the fan blades rotate at a fixed rotational speed with the hub, the fan blades of different thicknesses have different amount of deformation that varies with thickness of the fan blade, and thus the time for the fan blades of different thicknesses to pass through the narrow space of the housing is also different. In this way, the fan blades pass through the narrow space at different frequencies, so that the blade pass tone may be cut into a plurality of fine noises of different frequencies, and preventing a situation where noise energy starts to accumulate at a same frequency and resonances from being easily generated.

In order to make the aforementioned features and advantages of the disclosure more comprehensible, embodiments accompanying figures are described in detail below.

DESCRIPTION OF EMBODIMENTS

Figure 1:
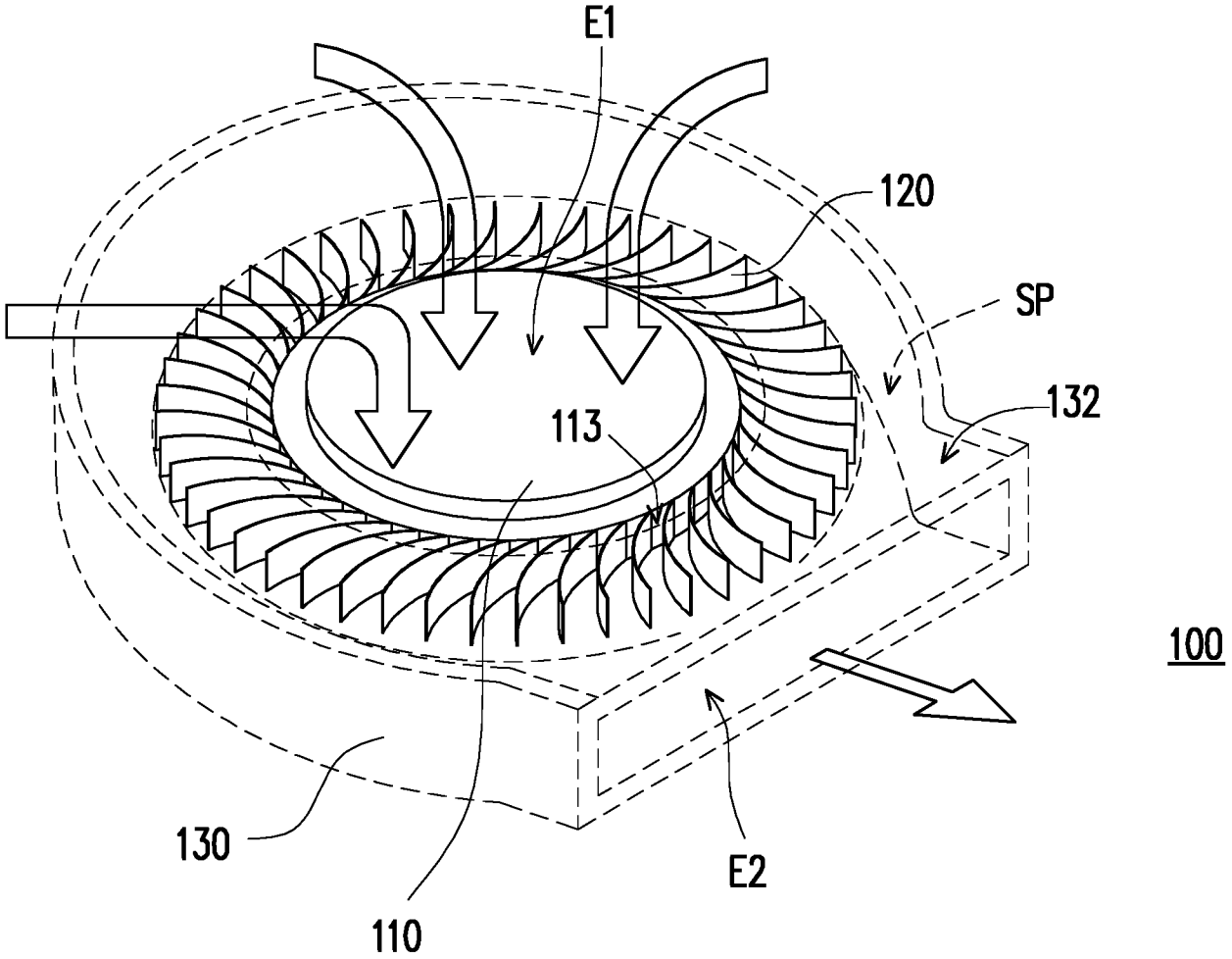
FIG. 1 is a schematic view of a heat dissipation fan according to an embodiment of the disclosure.

FIG. 1 is a schematic view of a heat dissipation fan according to an embodiment of the disclosure. Referring to FIG. 1, in the embodiment, the heat dissipation fan 100 is adapted to be disposed in an electronic device (e.g., a notebook computer) to effectively dissipate heat from the heat source of the electronic device. Since the disclosure provides no limitation to the type of the electronic device, the illustration of the electronic device is omitted here. Here, the heat dissipation fan 100 is, for example, a centrifugal fan, which includes a hub 110, a plurality of fan blades 120, and a housing 130, wherein the hub 110 and the fan blades 120 are accommodated within the housing 130, and the fan blades 120 are disposed and surround the hub 110, the hub 110 is controlled by a motor (not shown) to drive the fan blades 120 to rotate to cooperate with the air inlet E1 and the air outlet E2 of the housing 110 to generate an air flow state as indicated by arrows in FIG. 1.

Figure 2:
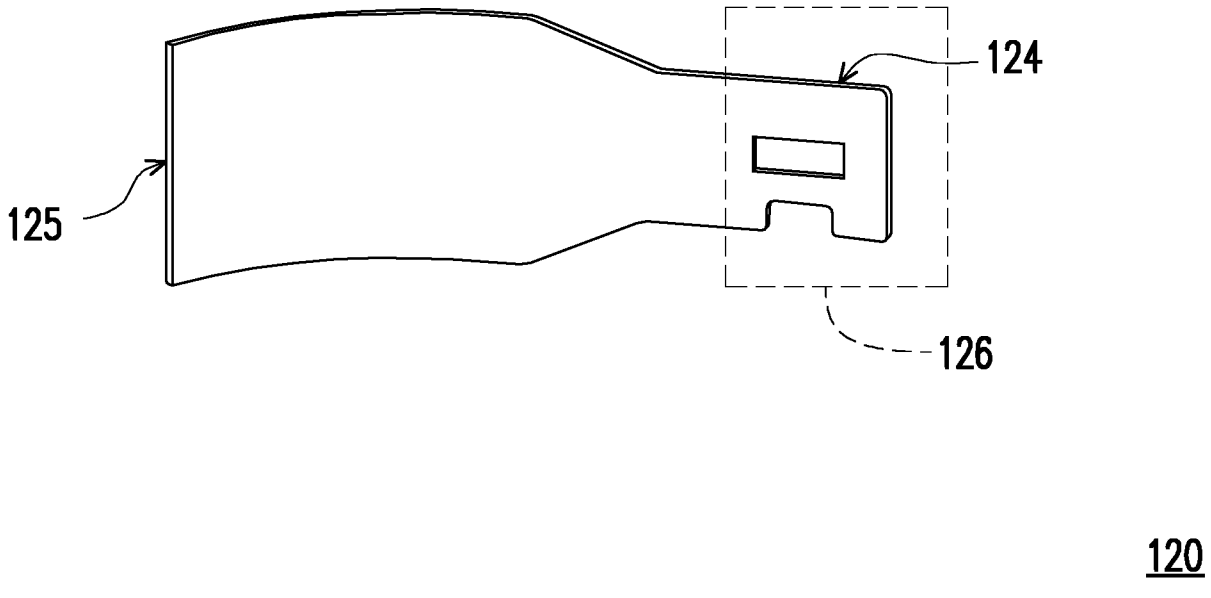
FIG. 2 is a schematic view of a fan blade.
Figure 3:
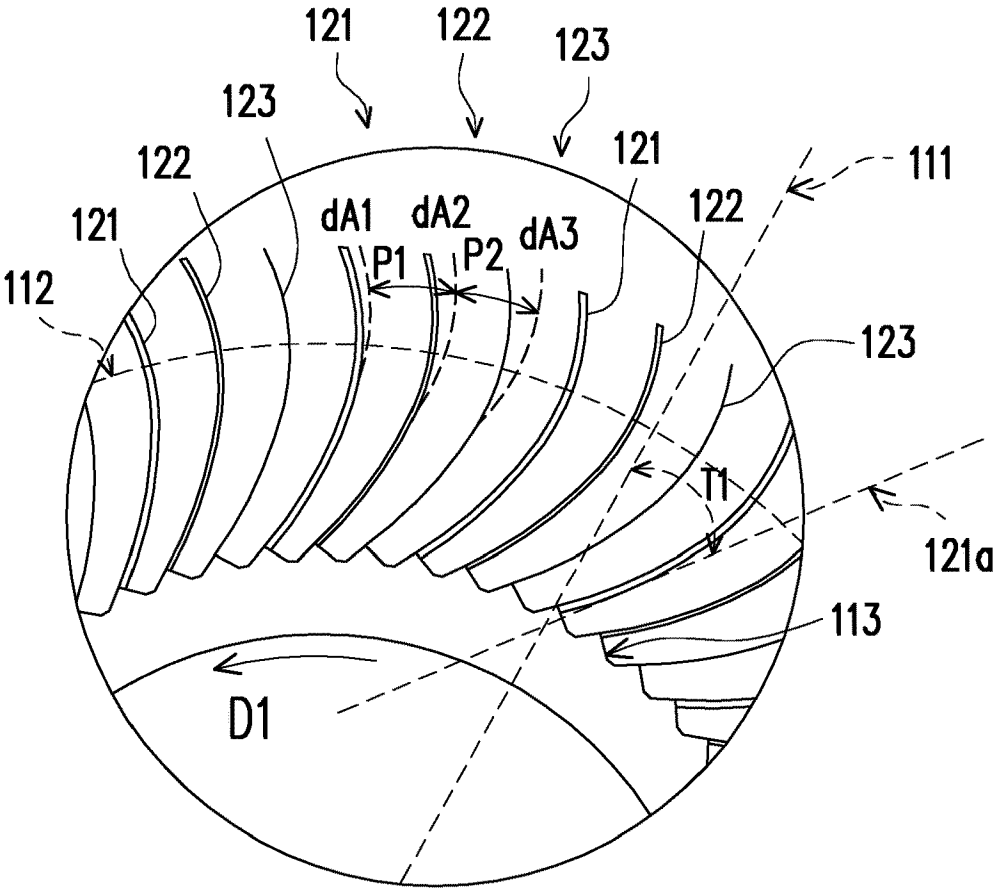
FIG. 3 is a top view of the heat dissipation fan of FIG. 1.
Figure 3:
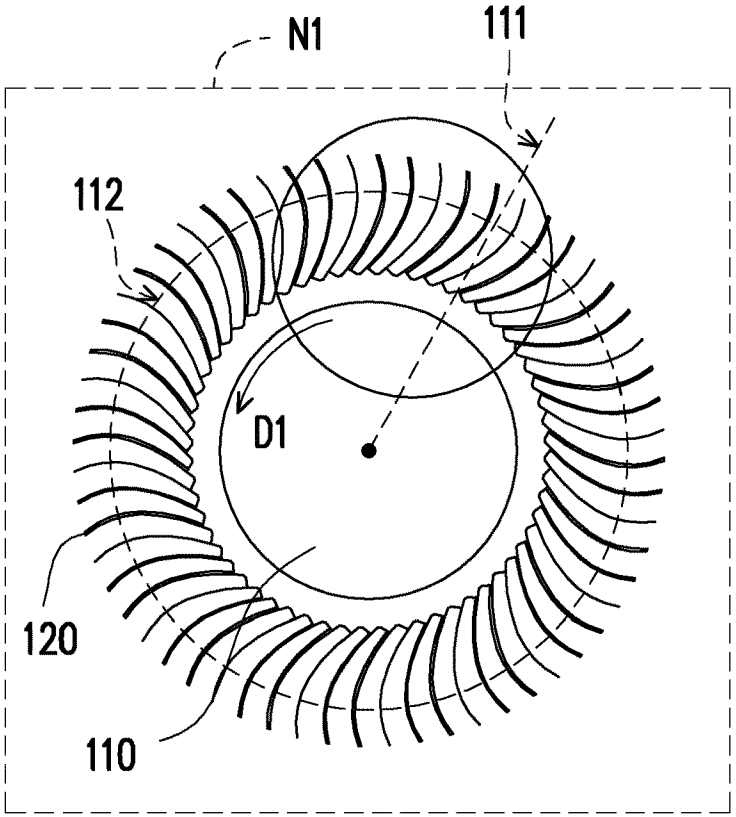

FIG. 2 is a schematic view of a fan blade. Referring to FIG. 1 and FIG. 2, in the embodiment, the material of the hub 110 is plastic or metal for die-casting, and the material of the fan blades 120 is metal. Therefore, the hub 110 may be jointed with the joint ends 124 of the fan blades 120 through injection molding (plastic) or die casting (metal) to fix the fan blades 120. Further, after the fabrication of the fan blades 120 is completed, the fan blades 120 are equal-thickness sheet-like structures having a thickness of less than 0.5 mm as shown in FIG. 3. Then, the fan blades 120 may be placed in a mold (not shown), and the plastic or the heated liquid metal is flown into the mold to cover the joint end 124 of the fan blades 120, so that the hub 110 that is formed by the plastic or the heated liquid metal fixes the fan blades 120 through the joint end 124 that is jointed with the fan blades 120. Here, the joint ends 124 of the respective fan blades 120 respectively have an interference structure 126 to cause interference between the hub 110 and the fan blades 120 during the formation of the hub 110, thereby enhancing the bonding force between the two. Here, the interference structure 126 has the recess and the opening to allow the structure of the hub 110 to pass through, thereby increasing the bonding area of the hub 110 and the fan blades 120 and causing the structure to be fitted and staggered with each other.

However, this embodiment provides no limitation to the manner in which the hub and the fan blades are combined. In another embodiment that is not shown, the hub and the fan blades are respectively provided with engaging structures corresponding to each other so as to be assembled and fixed together through engagement.

FIG. 3 is a top view of the heat dissipation fan of FIG. 1. Referring to FIG. 1 and FIG. 3, as shown in FIG. 1, the housing 130 has a tongue 132 which forms a narrow space SP in the space in which the hub 110 and the fan blades 120 are disposed. In such configuration, when the fan blades with equal thickness disposed at the hub by equal distance are manufactured with existing technology (i.e., plastic injection), the blade pass tone at fixed frequency and its harmonics are generated in the narrow space. However, compared with the related art described above, the fan blades 120 of the present embodiment is made of metal and has better ductility and flexibility. It should also be indicated that any two fan blades 120 next to each other have different thicknesses, as shown in FIG. 3. Therefore, when the fan blades 120 rotate with the hub 110, different amount of deformation will be generated for the fan blades 120. In this way, under the premise that the rotational speeds of the hub 110 and the fan blades 120 may not be changed arbitrarily or changed at any time, the present embodiment will cause the fan blades 120 of different thicknesses to pass through the protrusion 132 at different times, and therefore it is possible to change the movement mode in which the fan blades in existing technology travel through the narrow space SP at a fixed frequency. In other words, when the fan blades 120 of different thicknesses (causing different amounts of deformation) travel through the narrow space SP, they generate noise at different frequencies, so that energy accumulation of the same frequency noise may be avoided, and the volume may be reduced. Meanwhile, due to the multi-frequency characteristics, it is also possible to effectively reduce the discomfort caused to human hearing. In addition, in the present embodiment, the thickness of the fan blades 120 may be further reduced (for example, less than 0.5 mm) due to the material and characteristics of the fan blades 120. Therefore, the number of the fan blades 120 that may be disposed at the hub 110 for the heat dissipation fan 100 is greater than or equal to 50, which is obviously superior to the fan structure manufactured through plastic injection in existing technology.

Referring to FIG. 3 again, a partial enlargement is provided at the same time to facilitate recognition. In the embodiment, the hub 110 and the fan blades 120 are disposed on the reference plane N1 and rotated on the reference plane N1, and are viewed from a top viewing angle. The fan blades 120 are assembled on the hub 110 in a direction orthogonal to the reference plane N1. Here, the hub 110 has a lateral surface 113 (i.e., the annular surface of the hub 110) orthogonal to the reference plane N1, and the fan blades 120 coupled to the hub 110 extend from the lateral surface 113 at an oblique angle away from the hub 110, as the oblique angle T1 shown in the drawing, which is an angle between the tangential plane 121*a* of the joint portion (the joint portion 124 shown in FIG. 3) of the fan blades 121 and the radial plane 111 of the hub 110. Here, the radial plane 111 is a circular contour formed by the hub 110 in its top viewing angle and formed in a plane along its radial direction, wherein the radial plane 111 and the tangential plane 121*a* intersect each other at the junction of the hub 110 and the fan blades 120 and generate the oblique angle T1.

Furthermore, for the fan blades 120 disposed equidistantly at the hub 110, the radial planes 111 relative to the hub 110 are each formed in an arc-shaped contour, and the concave surface of the arc-shaped contour faces the rotation direction of the fan blades 120, that is, the counterclockwise direction D1, so that the fan blades 120 may further grasp air during the rotation, thereby enhancing the air flow amount of the heat dissipation fan 100.

As described above, due to the material characteristics of the fan blades of the present embodiment, different amounts of deformation are generated during the rotation. Here, the fan blades 121, 122, and 123 with three different thicknesses are described as an example. As shown in FIG. 3, the arrangement of the fan blades 120 with respect to the hub 110 is further configured in the manner that the fan blades 121, 122, and 123 are arranged in sequence to surround the hub 110 repeatedly, wherein the thickness of the fan blade 121 is greater than the thickness of the fan blade 122, and the thickness of the fan blade 122 is greater than the thickness of the fan blade 123. In this manner, when the fan blade 120 rotates in the counterclockwise direction D1 with the hub 110, the deformation amounts dA1, dA2, and dA3 generated by the fan blades 121, 122, and 123 are generated respectively, and the deformation amount dA3 is greater than the deformation amount dA2, and the deformation amount dA2 is greater than the deformation amount dA1. Here, the deformation amounts dA1, dA2, and dA3 are based on the arc-shaped surface 112 with equal diameter of the hub 110. Furthermore, the deformation amounts dA1, dA2, and dA3 further cause the pitch p1 of the deformed fan blades 121 and 122 and the pitch p2 of the deformed fan blades 122 and 123 to be unequal. As such, as the fan blade 120 is rotated at a fixed rotational speed with the hub 110, the frequency of passing through the narrow space SP (shown in FIG. 1) also varies due to the change in spacing. In other words, in the present embodiment, by designing the fan blades 120 to include a distribution of at least three thicknesses, the fan blades 120 may be made to have different pitches to achieve the noise reducing effect as described above.

Figure 4:
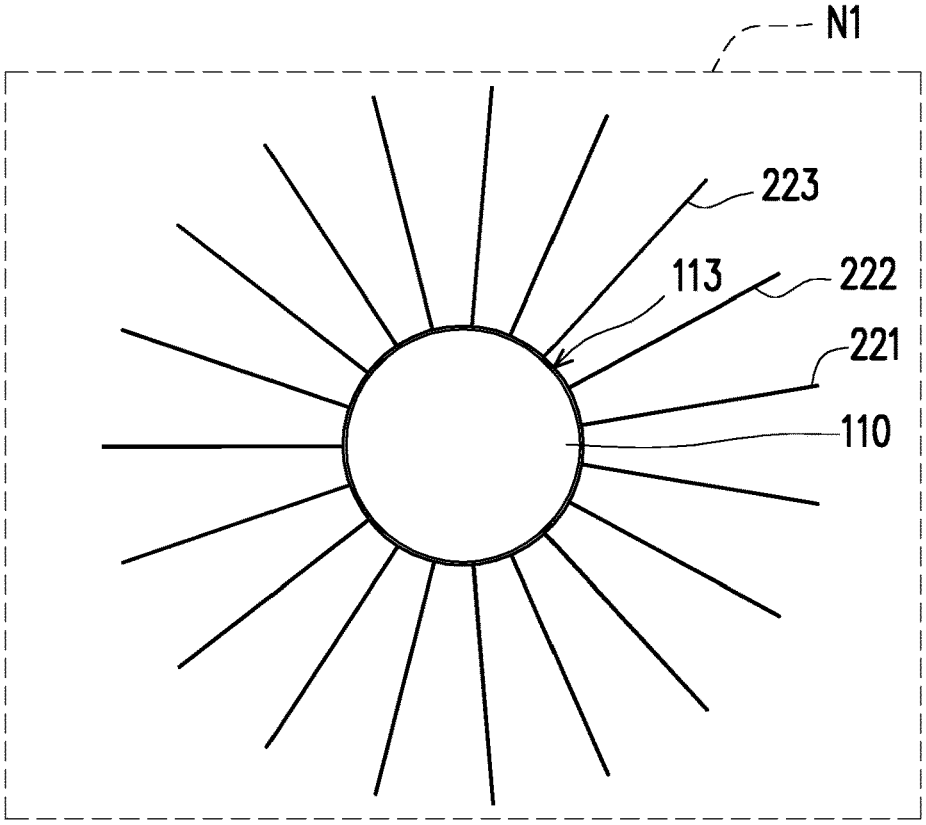
FIG. 4 is a top view of a heat dissipation fan according to another embodiment of the present disclosure.
Figure 5:
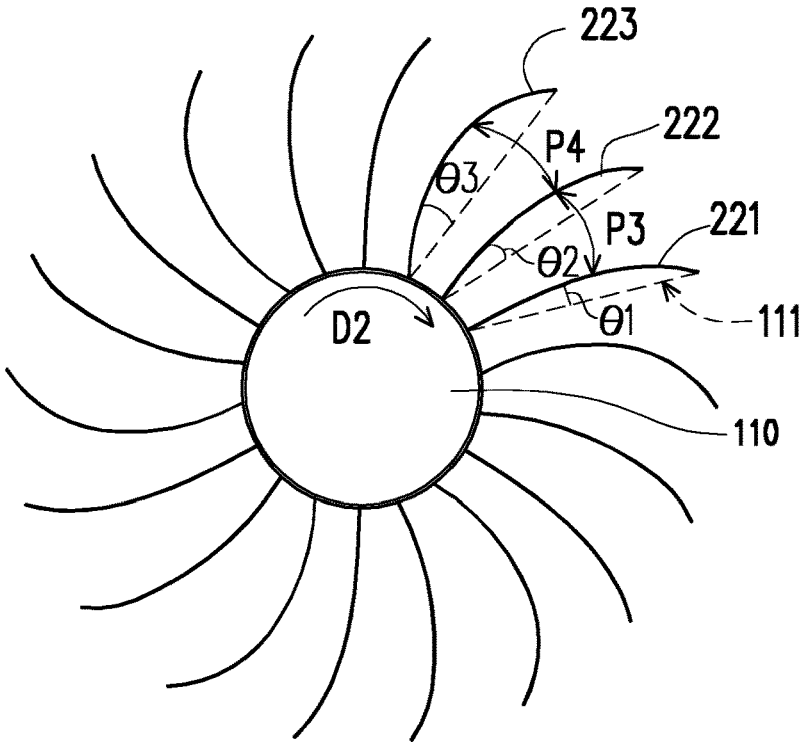
FIG. 5 and FIG. 6 are top views of the fan of FIG. 4 at different rotational speeds, respectively.
Figure 6:
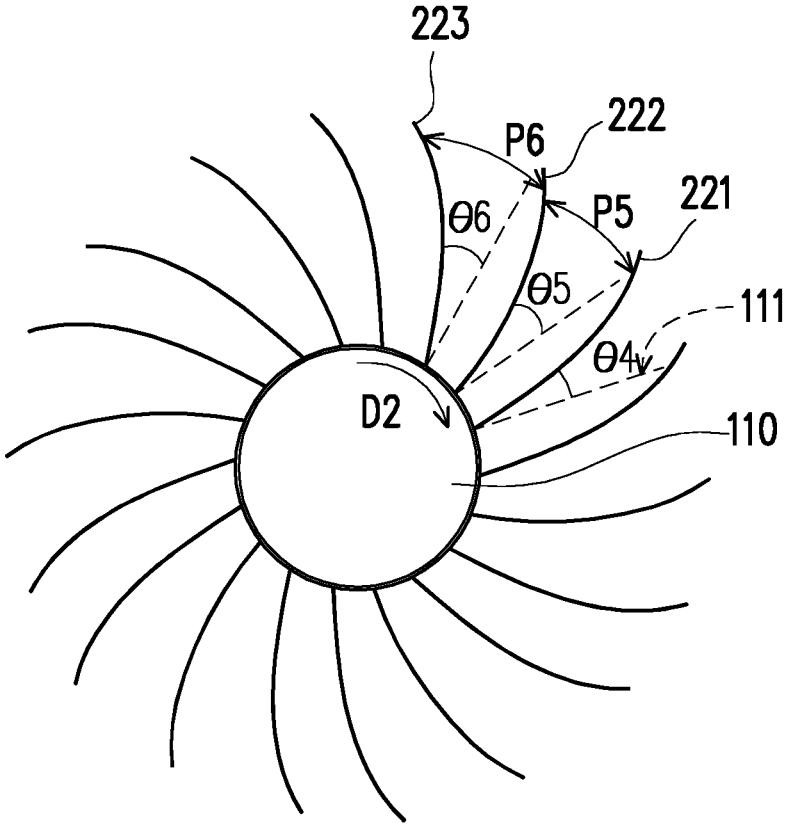

FIG. 4 is a top view of a heat dissipation fan according to another embodiment of the present disclosure. FIG. 5 and FIG. 6 are top views of the fan of FIG. 4 at different rotational speeds, respectively. Referring to FIG. 4 to FIG. 6, the hub 110 of the present embodiment has a lateral surface 113 orthogonal to the reference plane N1. Unlike the foregoing embodiment, the fan blades 220 of the present embodiment are extended radially from the lateral surface 113 facing away from the hub 110. In addition, the present embodiment also describes the difference in deformation during rotation with the fan blades 221, 222, and 223 of three different thicknesses as an example, wherein the thickness of the fan blade 221 is greater than the thickness of the fan blade 222, and the thickness of the fan blade 222 is greater than the thickness of the fan blade 223. As shown in FIG. 5, when the hub 110 drives the fan blade 220 to rotate in the clockwise direction D2 at a low rotational speed, the fan blades 221, 222, and 223 of different thicknesses generate different amounts of deformation, respectively, where the amount of deformation is described through the different oblique angles θ1, θ2, and θ3 generated by the fan blades 221, 222 and 223 with respect to the radial plane 111 of the hub 110. Specifically, the oblique angle θ3 is greater than the oblique angle θ2, and the oblique angle θ2 is greater than the oblique angle θ1, so it represents that the deformation amount of the fan blade 223 is greater than the deformation amount of the fan blade 222, and the deformation amount of the fan blade 222 is greater than the deformation amount of the fan blade 221, and the configuration further causes the pitch p3 to not equal to the pitch p4. On this occasion, each of the fan blades 220 is affected by the airflow and the resistance of the material property to the airflow, that is, the material property of the fan blade is still able to resist the pushing of the airflow, and is in the state of being slightly bent. On this occasion, the slightly bent fan blade 220 may provide a higher amount of airflow at a low rotational speed, thereby improving the heat dissipation performance of the heat dissipation fan 100 at a low rotational speed.

On the other hand, when the hub 110 drives the fan blade 220 at a high rotational speed, as shown in FIG. 6, the material property of the fan blade 120 may no longer smoothly resist the pushing of the airflow, and is therefore in the state of being bent backward. As a result, the fan blades 221, 222, 223 of different thicknesses generate different oblique angles θ4, θ5, θ6, wherein the oblique angle θ6 is greater than the oblique angle θ5, and the oblique angle θ5 is greater than the oblique angle θ4, and the configuration further causes the pitch p5 to not equal to the pitch p6. In addition to achieving the noise reducing effect by unequal spacing as in the previous embodiment, the fan blade 220 that is bent backward may also reduce the noise during operation of the heat dissipation fan at a high rotational speed, thereby providing further noise suppressing effect.

In summary, in the above embodiment of the present disclosure, by arranging the fan blades of different thicknesses at the hub, and the fan blades have ductility and flexibility, when the fan blades are rotated at a fixed rotational speed with the hub, the blade of different thicknesses may generate different amounts of deformation that are changed along with thicknesses, such that the different thicknesses pass through the narrow space of the housing at different times. On the other hand, by designing the thickness of the fan blades to include at least three sizes, it is also possible to make the spacing between the fan blades to change along with different amounts of deformation.

In this way, the configuration will cause the fan blades pass through the narrow space at different frequencies, so that the blade pass tone may be cut into a plurality of fine noises of different frequencies, thereby preventing an accumulation of noise energy at a same frequency and resonances from being easily generated. Therefore, it is possible for the heat dissipation fan to reduce or even suppress noise smoothly.

Although the disclosure has been disclosed by the above embodiments, the embodiments are not intended to limit the disclosure. It will be apparent to those skilled in the art that various modifications and variations may be made to the structure of the disclosure without departing from the scope or spirit of the disclosure. Therefore, the protecting range of the disclosure falls in the appended claims.

What is claimed is:

1. A heat dissipation fan, adapted to be disposed in an electronic device, the heat dissipation fan comprising:

a hub; and a plurality of fan blades, surrounding and disposed at the hub, wherein the fan blades have ductility and flexibility, and any two of the fan blades next to each other have different thicknesses, wherein each of the fan blades is a sheet-like structure with constant thickness and the fan blades comprise at least three thicknesses.

2. The heat dissipation fan according to claim 1, wherein a material of the fan blades is metal.

3. The heat dissipation fan according to claim 1, further comprising a housing disposed in the electronic device, the hub and the fan blades are received in the housing, the housing has a tongue portion disposed on one side of an air outlet of the heat dissipation fan.

4. The heat dissipation fan according to claim 1, wherein the hub and the fan blades are located on a reference plane and rotated on the reference plane, and the fan blades are respectively assembled on the hub in a direction orthogonal to the reference plane.

5. The heat dissipation fan according to claim 4, wherein the hub has a lateral surface orthogonal to the reference plane, and the fan blades are extended radially from the lateral surface.

6. The heat dissipation fan according to claim 4, wherein the hub has a lateral surface orthogonal to the reference plane, and the fan blades are extended at an oblique angle relative to the lateral surface.

7. The heat dissipation fan according to claim 1, wherein each of the fan blades has an arc-shaped contour with respect to a radial plane of the hub, and a concave surface of the arc-shaped contour faces a rotation direction of the fan blades.

8. The heat dissipation fan according to claim 1, wherein the fan blades are equidistantly disposed at the hub.

9. The heat dissipation fan according to claim 1, wherein each of the fan blades has a thickness of less than 0.5 mm.

10. The heat dissipation fan according to claim 1, wherein the number of the fan blades is greater than or equal to 50.

* * * * *